United States Patent [19]

Takeuchi et al.

[11] Patent Number: 4,784,332

[45] Date of Patent: Nov. 15, 1988

[54] SPRAY HEAD OF A ROTARY TYPE ELECTROSTATIC SPRAY PAINTING DEVICE

[75] Inventors: Hitoshi Takeuchi, Toyota; Iwao Nomura, Kasugai; Yasuo Tokushima, Toyota; Koji Ota, Toyota; Naoki Yamada, Toyota, all of Japan

[73] Assignee: Toyota Jidosha Kabushiki Kaisha, Aichi, Japan

[21] Appl. No.: 81,452

[22] Filed: Aug. 4, 1987

[30] Foreign Application Priority Data

Mar. 19, 1987 [JP] Japan ..... 62-62444

[51] Int. Cl.[4] ..... B05B 5/04

[52] U.S. Cl. ..... 239/703; 239/222.11; 239/223

[58] Field of Search ..... 239/700–703, 239/222.11, 223, 224

[56] References Cited

U.S. PATENT DOCUMENTS

| | | | |
|---|---|---|---|
| Re. 31,590 | 5/1984 | Mitsui | 239/703 X |
| 2,220,275 | 11/1940 | Preston | 239/223 |
| 2,893,894 | 7/1959 | Ransburg . | |
| 3,290,169 | 12/1966 | Sedlacsik, Jr. | 239/700 X |
| 4,148,932 | 4/1979 | Tada et al. | 239/700 X |
| 4,369,924 | 1/1983 | Morishita et al. | 239/703 |
| 4,376,135 | 3/1983 | Patel et al. | 239/700 X |
| 4,458,844 | 7/1984 | Mitsui | 239/703 |
| 4,518,119 | 5/1985 | Vetter | 239/703 X |

FOREIGN PATENT DOCUMENTS

| | | |
|---|---|---|
| 307088 | 10/1948 | Japan . |
| 55-41825 | 10/1980 | Japan . |
| 58-174263 | 11/1983 | Japan . |
| 58-190456 | 12/1983 | Japan . |
| 60-57908 | 12/1985 | Japan . |

*Primary Examiner*—Andres Kashnikow
*Assistant Examiner*—Mary Beth O. Jones
*Attorney, Agent, or Firm*—Parkhurst, Oliff & Berridge

[57] ABSTRACT

A spray head of rotating type electrostatic spray painting device comprises a cup shaped inner circumferential wall and a tip portion from which paint particles are discharged. The outer periphery of the tip portion is formed as an annular flat face perpendicular to the rotating axis of the spray head. The inner periphery of the tip portion is formed as a conical face which diverges toward the outside of the spray head. A plurality of paint guide grooves are formed on only the inner periphery of the conical face.

9 Claims, 2 Drawing Sheets

SPRAY HEAD OF A ROTARY TYPE ELECTROSTATIC SPRAY PAINTING DEVICE

BACKGROUND OF THE INVENTION

1. Field of the Invention

The present invention relates to a spray head of a rotary type electrostatic spray painting device.

2. Description of the Related Art

In a rotary type electrostatic spray painting device in which paint is fed onto a cup-shaped inner circumferential wall of a spray head while the spray head is rotating, and in which a spray of paint is discharged from a tip of the spray head, the necessary atomization of the paint is greatly influenced by the shape of the tip of the spray head. To improve this atomization of the paint, a rotary type electrostatic spray painting device has been disclosed in which a plurality of paint guide grooves extending to a knife edge-shaped tip of the spray head are formed on the cup shaped inner circumferential wall of the spray head (see Japanese Examined Patent Publication No. 30-7088). Another rotary type electrostatic spray painting device has been disclosed in which the knife edge shaped tip of the spray head is corrugated (see Japanese Examined Patent Publication No. 36-1266). Other rotary type electrostatic spray painting devices also have been disclosed, in which a plurality of paint guide grooves are formed on the inner circumferential wall of the knife edge shaped tip of the spray head (see Japanese Examined Patent Publication No. 55-41825, Japanese Unexamined Utility Model Publication No. 58-174263, U.S. Pat. No. 4,148,932, U.S. Reissue Pat. No. 31,590, and U.S. Pat. No. 4,458,844).

However, when the tip of the spray head is provided with a knife edge shape, the electrical field becomes stronger at the knife edge shaped tip of the spray head and, therefore, an extremely large dark current flows between the knife edge shaped tip of the spray head and the surface to be painted. This extremely large dark current causes painting defects such as "flower spots" or "cratering" to appear on the painted surface.

To prevent this strengthening of the electrical field at the tip of the spray head, a rotary type electrostatic spray painting device has been disclosed in which the tip of the spray head is provided with an annular flat face perpendicular to the rotating axis of the spray head, and a plurality of paint guide grooves are formed on only the inner peripheral portion of the annular flat face (see Japanese Examined Patent Publication No. 60-57908).

In addition, to prevent an accumulation of paint dregs on the cup-shaped inner circumferential wall of the spray head and in the paint guide grooves, a thin layer of a plastic is formed on the cup-shaped inner circumferential wall of the spray head and on the surfaces of the paint guide grooves (see Japanese Unexamined Utility Model Publication No. 58-190456).

Furthermore, to prevent wear of the cup-shaped inner circumferential wall of the spray head and the surface of the paint guide grooves caused by the inorganic pigments contained in a paint, the present applicant has proposed a rotary type electrostatic spray painting device in a copending Japanese Utility Model Application No. 61-194126. In this device, a hardened layer formed by an anode oxidizing treatment is applied on the cup shaped inner circumferential wall of the spray head and on the surface of the paint guide grooves.

Note, as mentioned above, the atomization of the paint is greatly influenced by tip of the spray head, and thus the tip of the spray head and the paint guide grooves are normally formed by a machining operation. Consequently, in a conventional spray head, the paint guide grooves are normally formed so that they open onto the tip face of the spray head, to facilitate the machining operation. However, if the paint guide grooves are open at the tip face of the spray head, the chances that the openings of the paint guide grooves will come into contact with other articles are increased, particularly when the spray head is removed. This could result in a problem of a deformation of the openings of the paint guide grooves, preventing a proper flow of paint.

SUMMARY OF THE INVENTION

An object of the present invention is to provide a spray head which can be easily formed by a machining operation and which is capable of protecting the paint guide grooves from damage.

According to the present invention, there is provided a spray head of a rotary type electrostatic spray painting device, comprising a cup shaped inner circumferential wall and a tip portion formed at an end of the cup shaped inner circumferential wall, the tip portion comprising: an annular flat face portion perpendicular to a rotating axis of the spray head and located at an outer periphery of the tip portion; a conical face portion extending from an inner peripheral end of the annular flat face portion to the cup shaped inner circumferential wall and diverging toward an outside of the spray head; and a plurality of paint guide grooves formed on an inner peripheral portion of the conical face portion and connected to the cup shaped inner circumferential wall, the conical face portion having a conically shaped paint guide face portion positioned between the annular flat face portion and the paint guide grooves.

The present invention may be more fully understood from the description of a preferred embodiment of the invention set forth below, together with the accompanying drawings.

DESCRIPTION OF A PREFERRED EMBODIMENT

Figure 1:
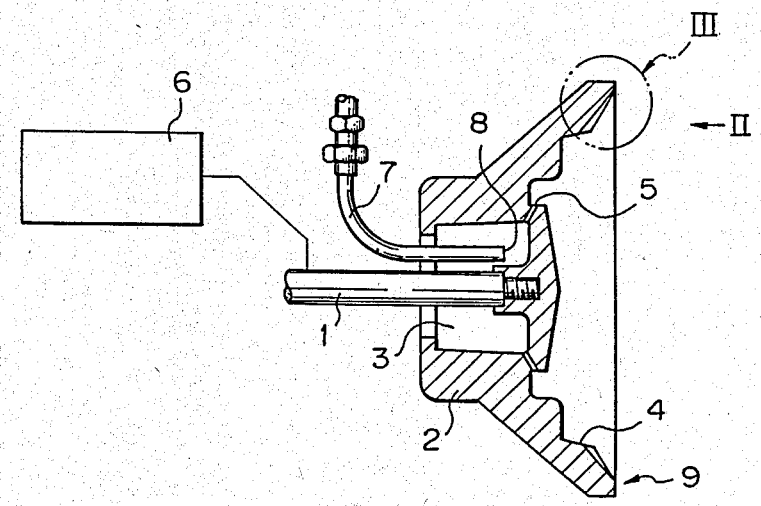
FIG. 1 is a cross-sectional side view of a spray head according to the present invention.

Referring to FIG. 1, reference numeral 1 designates a rotary shaft, 2 a spray head fixed to the rotary shaft 1, 3 an annular space formed in the spray head 2, and 4 a cup-shaped inner wall; 5 designates a plurality of paint outflow bores connecting the circumferential wall of the deepest portion of the annular space 3 to the inner peripheral portion of the cup-shaped inner wall 4, 6 a high voltage generating apparatus for applying a negative high voltage to the rotary shaft 1, and 7 a paint feed nozzle. A nozzle mouth 8 of the paint feed nozzle 7 is arranged in the annular space 3. When the painting operation is started, the spray head 2 is rotated at a high speed and paint is fed into the annular space 3 from the paint feed nozzle 7. This paint then passes through the fuel outflow bores 5 and flows out into the inner periphery of the cup shaped inner circumferential wall 4. Then, the paint flows and spreads on the cup shaped inner circumferential wall 4 toward the tip 9 of the spray head 2 in the form of a thin liquid film. The paint is then discharged from the tip 9 of the spray head 2 toward the surface to be painted in the form of fine particles which are charged with electrons.

Figure 2:
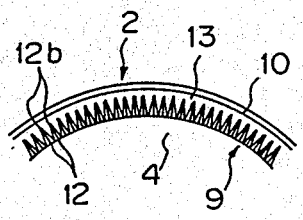
FIG. 2 is a front view of a part of the tip portion of the spray head, taken along the arrow 11 in FIG. 1.
Figure 3:
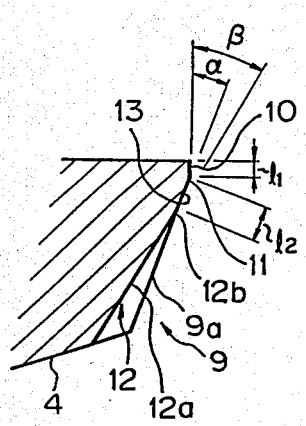
FIG. 3 is an enlarged cross-sectional side view of the portion of the spray head enclosed by the circle III in FIG. 1.

Referring to FIGS. 1 through 3, the outer peripheral portion 10 of the tip 9 of the spray head 2 is formed as an annular flat face 10 which is perpendicular to the rotating axis of the rotary shaft 1. The annular flat face 10 has a uniform width $l_1$ over the entire length thereof. In the embodiment illustrated in FIGS. 1 through 3, this width $l_1$ is about 0.2 to 0.5 mm. A portion 9*a* of the tip 9, which extends from the inner peripheral end 11 of the annular flat face 10 to the cup shaped inner circumferential wall 4, is formed as a conical face which diverges toward the outside of the spray head 2. As illustrated in FIG. 3, an angle $\alpha$ in the cross-section between the conical face 9*a* and the annular flat face 10 is about 10 to 25 degrees. A plurality of paint guide grooves 12 each having the same shape are formed on the inner peripheral portion of the conical face 9*a*. The paint guide grooves 12 have a V shaped cross-section, and the depth of the paint guide grooves 12 is gradually decreased from the cup shaped inner circumferential wall 4 towards the annular flat face 10, as illustrated in FIG. 3. Consequently, as illustrated in FIG. 2, the width of the paint guide grooves 12 is also gradually decreased from the cup shaped inner circumferential wall 4 toward the annular flat face 10. Since the paint guide grooves 12 are formed on the conical face 9*a*, and the depth of the paint guide grooves 12 is gradually decreased from the cup shaped inner circumferential wall 4 toward the annular flat face 10, an angle $\beta$ in the cross-section between the annular flat face 10 and the bottom 12*a* of the paint guide grooves 12 becomes greater than $\alpha$. This angle $\beta$ is about 20 to 35 degrees. Since the paint guide grooves 12 are formed on only the inner peripheral portion of the conical face 9*a*, a conical paint guide face 13 is formed between the annular flat face 10 and the paint outflow end 12*b* of the paint guide grooves 12. The paint guide face 13 has a uniform width $l_2$ over the entire length of the tip 9 of the spray head 2. This width $l_2$ is about 0.3 to 0.8 mm. The spray head 2 is made of aluminum alloy, and an electric conductive hardened layer of oxidized aluminum formed by the anode oxidizing treatment is coated on the cup shaped inner circumferential wall 4, the walls of the paint guide grooves 12, the paint guide face 13, and the annular flat face 10.

As mentioned above, when the painting operation is carried out, the paint flows and spreads on the cup shaped inner circumferential wall 4 toward the tip 9 of the spray head 2, in the form of a thin liquid film. The paint is then uniformly divided and allowed to flow into the paint guide grooves 12. Subsequently, the paint flows radially outwardly along the bottom 12*a* of the paint guide grooves 12. At this time, since an extremely large centrifugal force is acting on the paint streams flowing within the paint guide grooves 12, the flow of the paint streams is accelerated in the paint guide grooves 12 and they become extremely thin filament shaped paint streams. These filament shaped paint streams flow out from the paint guide grooves 12 onto the conical paint guide face 13 while spaced at equal distances apart. Then, the paint streams flow onto the annular flat face 10, while still equally spaced apart, and then are discharged from the outer peripheral of the annular flat face 10 while equally spaced apart. The filament shaped paint streams are then scattered and become fine particles charged with electrons. As mentioned above, since the paint particles are formed in such a way that the extremely thin filament shaped paint streams are scattered, there is no danger that the paint particles will contain air when they are formed. Namely, paint particles containing no air are formed.

As illustrated in FIG. 1, since the annular flat face 10 having a uniform width $l_1$ is formed on the tip 9 of the spray head 2, the amount of dark current is reduced, and as a result, it is possible to prevent painting defects such as flower spots and cratering on the painted surface. In addition, as mentioned above, since the hardened layer formed by the anode oxidizing treatment is coated on the cup shaped inner circumferential face 4, the faces of the paint guide grooves 12, the paint guide face 13, and the annular flat face 10, it is possible to prevent wear of these faces by inorganic pigments contained in the paint.

Figure 4:
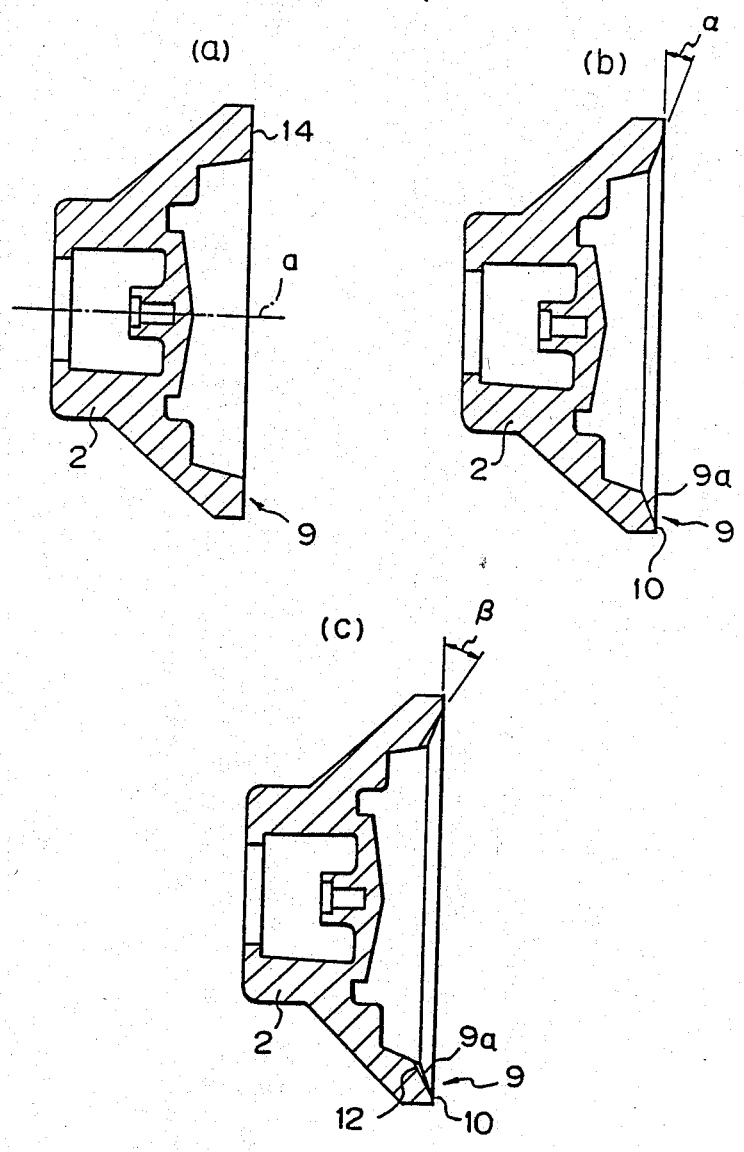
FIG. 4 is a view illustrating the machining operation for the spray head.

The method of machining the tip 9 of the spray head 2 will be described hereinafter with reference to FIG. 4.

As illustrated in FIG. 4*a*, the flat tip face 14 is initially formed by cutting o, grinding the tip of the spray head 2 by a machining operation. Then, as illustrated in FIG. 4*b*, the inner peripheral portion of the flat tip face 14 is cut or ground by another machining operation, thus forming the conical face 9*a* on the inner peripheral portion of the flat tip face 14. At the same time, the annular flat face 10 is formed. It is extremely easy to form the conical face 9*a* by a machining operation and, therefore, a great deal of time and labour is saved in the formation of the conical face 9*a*. Then, as illustrated in FIG. 4*c*, a plurality of the paint guide grooves 12 are formed on the inner peripheral portion of the conical face 9*a* by a machining operation.

As illustrated in FIG. 3, all of the paint guide grooves 12 are retracted inward from the annular flat face 10, and thus the paint overflow ends 12*b* of the paint guide grooves 12 are also retracted from the annular flat face 10. Therefore, even when the spray head 2 is removed, there is no danger that the paint outflow ends 12*b* of the paint guide grooves 12 will come into contact with other articles, and thus it is possible to prevent damage to the paint guide grooves 12.

According to the present invention, as mentioned above, by forming the conical face, which can be easily formed by a machining operation, on the tip of the spray head, it is possible to prevent deformation of the paint guide grooves.

While the invention has been described by reference to a specific embodiment chosen for purposes of illustration, it should be apparent that numerous modifications could be made thereto by those skilled in the art without departing from the basic concept and scope of the invention.

We claim:

1. A spray head of a rotary type electrostatic spray painting device, comprising a cup shaped inner circumferential wall and a tip portion formed at an end of said cup shaped inner circumferential wall, said tip portion comprising: an annular flat face portion perpendicular to a rotating axis of the spray head and located at an outer periphery of said tip portion; a conical face portion extending from an inner peripheral end of said annular flat face portion to said cup shaped inner circumferential wall and diverging toward an outside of the spray head; and a plurality of paint guide grooves formed on an inner peripheral portion of said conical face portion and connected to said cup shaped inner circumferential wall, said conical face portion having a conically shaped paint guide face portion positioned between said annular flat face portion and said paint guide grooves.

2. A spray head according to claim 1, wherein each of said paint guide grooves has a V shaped cross-section and has a depth and a width which are gradually decreased from said cup shaped inner circumferential wall toward said annular flat face portion.

3. A spray head according to claim 1, wherein said conical face portion is formed by a machining operation.

4. A spray head according to claim 1, wherein said annular flat face portion is formed by a machining operation.

5. A spray head according to claim 1, wherein said paint guide grooves are formed by a machining operation.

6. A spray head according to claim 1, wherein an angle in cross-section between said annular flat face portion and said conical face portion is about 10 to 25 degrees.

7. A spray head according to claim 1, wherein an angle in cross-section between said annular flat face portion and a bottom of said paint guide groove is about 20 to 35 degrees.

8. A spray head according to claim 1, wherein a hardened layer is formed on said cup shaped inner circumferential wall, said annular flat portion, said conical face portion and surfaces of said paint guide grooves.

9. A spray head according to claim 8, wherein said hardened layer is formed by an anode oxidizing treatment.

* * * * *